US011788215B2

(12) United States Patent
Zavala

(10) Patent No.: US 11,788,215 B2
(45) Date of Patent: Oct. 17, 2023

(54) UPPER FOR AN ARTICLE OF FOOTWEAR WITH A CUFF

(71) Applicant: NIKE, Inc., Beaverton, OR (US)

(72) Inventor: Roberto Zavala, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/705,006

(22) Filed: Mar. 25, 2022

(65) Prior Publication Data

US 2022/0213625 A1 Jul. 7, 2022

Related U.S. Application Data

(60) Continuation of application No. 16/380,278, filed on Apr. 10, 2019, now Pat. No. 11,313,057, which is a division of application No. 15/454,034, filed on Mar. 9, 2017, now Pat. No. 10,669,654.

(60) Provisional application No. 62/307,115, filed on Mar. 11, 2016.

(51) Int. Cl.

| | |
|---|---|
| ***D04B 1/10*** | (2006.01) |
| ***A43B 23/02*** | (2006.01) |
| ***A43B 1/04*** | (2022.01) |
| ***A43B 23/04*** | (2006.01) |

(52) U.S. Cl.

CPC ..... *D04B 1/106* (2013.01); *A43B 1/04* (2013.01); *A43B 23/024* (2013.01); *A43B 23/027* (2013.01); *A43B 23/0265* (2013.01); *A43B 23/042* (2013.01); *D04B 1/104* (2013.01); *D10B 2403/0114* (2013.01); *D10B 2501/043* (2013.01)

(58) Field of Classification Search

CPC ..... D04B 1/106; D04B 1/104; D04B 1/10; D04B 7/04; D04B 7/06; A43B 1/04

See application file for complete search history.

(56) References Cited

U.S. PATENT DOCUMENTS

| | | | |
|---|---|---|---|
| 2,147,197 | A | 2/1939 | Glidden |
| 2,314,098 | A | 3/1943 | Raymond |
| 2,675,631 | A | 4/1954 | Carr |

(Continued)

FOREIGN PATENT DOCUMENTS

| | | | |
|---|---|---|---|
| CN | 1834323 | A | 9/2006 |
| CN | 102560840 | A | 7/2012 |

(Continued)

OTHER PUBLICATIONS

Office action received for European Patent Application No. 17711973.2, dated Oct. 21, 2022, 6 pages.

(Continued)

*Primary Examiner* — Danny Worrell

(74) *Attorney, Agent, or Firm* — SHOOK, HARDY & BACON L.L.P.

(57) ABSTRACT

In one aspect, an upper for an article of footwear may include a knit element, a collar area configured to form an ankle opening, and a cuff in the collar area. The cuff may be at least partially formed by the knit element and may include a ribbed knit structure of the knit element. In another aspect, an upper for an article of footwear may include a knit element with a first area, the first area including a first side and a second side opposite the first side. The first side may be formed of at least 30% more material than the second side such that the first area is configured to curve convexly away from the first side.

20 Claims, 6 Drawing Sheets

(56) References Cited

U.S. PATENT DOCUMENTS

| | | | | |
|---|---|---|---|---|
| 3,670,529 | A | 6/1972 | Fregeolle | |
| 3,937,039 | A | 2/1976 | Anderson | |
| 3,990,115 | A | 11/1976 | Nester | |
| 4,034,580 | A | 7/1977 | Holder | |
| 4,237,707 | A | 12/1980 | Coble et al. | |
| 4,702,091 | A | 10/1987 | Good et al. | |
| 4,891,958 | A | 1/1990 | Cournoyer et al. | |
| 5,428,975 | A | 7/1995 | Lee et al. | |
| 6,173,589 | B1 | 1/2001 | Hayes et al. | |
| 6,223,565 | B1 | 5/2001 | Cooper | |
| 6,931,762 | B1 | 8/2005 | Dua | |
| 7,013,680 | B1 | 3/2006 | Adams | |
| 8,209,883 | B2 | 7/2012 | Lyden | |
| 8,327,669 | B2 | 12/2012 | Weihermueller | |
| 9,078,488 | B1 | 7/2015 | Meir et al. | |
| 9,145,629 | B2 | 9/2015 | Podhajny | |
| 9,192,204 | B1 | 11/2015 | Liles et al. | |
| 9,347,158 | B2 | 5/2016 | Cabouillet et al. | |
| 9,357,813 | B2 | 6/2016 | Lyden | |
| 9,498,023 | B2 | 11/2016 | Craig | |
| 9,840,793 | B2 | 12/2017 | Woodruff et al. | |
| 10,145,041 | B2 | 12/2018 | Terai et al. | |
| 10,182,617 | B2 | 1/2019 | Craig | |
| 10,669,654 | B2 * | 6/2020 | Zavala | D04B 1/106 |
| 11,313,057 | B2 * | 4/2022 | Zavala | D04B 1/106 |
| 2006/0016507 | A1 | 1/2006 | Baer | |
| 2007/0163305 | A1 | 7/2007 | Baer et al. | |
| 2011/0041359 | A1 * | 2/2011 | Dojan | A43C 1/00 36/47 |
| 2013/0019500 | A1 * | 1/2013 | Greene | A43B 23/0245 36/50.1 |
| 2014/0137433 | A1 | 5/2014 | Craig | |
| 2014/0137434 | A1 | 5/2014 | Craig | |
| 2014/0150292 | A1 | 6/2014 | Podhajny et al. | |
| 2014/0237861 | A1 | 8/2014 | Podhajny | |
| 2015/0173458 | A1 | 6/2015 | Ikenaka | |
| 2015/0359290 | A1 | 12/2015 | Podhajny et al. | |
| 2016/0029736 | A1 | 2/2016 | Meir | |
| 2016/0208421 | A1 | 7/2016 | Baines et al. | |
| 2017/0258169 | A1 | 9/2017 | Zavala | |
| 2019/0231022 | A1 | 8/2019 | Zavala | |

FOREIGN PATENT DOCUMENTS

| | | | |
|---|---|---|---|
| CN | 104824901 | A | 8/2015 |
| CN | 204763685 | U | 11/2015 |
| CN | 204763686 | U | 11/2015 |
| EP | 2904920 | A2 | 8/2015 |
| GB | 984564 | A | 2/1965 |
| TW | 201528981 | A | 8/2015 |
| TW | 201603737 | A | 2/2016 |
| WO | 2015/011148 | A1 | 1/2015 |

OTHER PUBLICATIONS

Office action received for European Patent Application No. 17712362.7, dated Sep. 15, 2022, 3 pages.

Office Action received for European Patent Application No. 17712362.7, dated May 4, 2023, 5 pages.

* cited by examiner

UPPER FOR AN ARTICLE OF FOOTWEAR WITH A CUFF

CROSS-REFERENCE TO RELATED APPLICATIONS

This application, having U.S. application Ser. No. 17/705,006 and entitled "AN UPPER FOR AN ARTICLE OF FOOTWEAR WITH A CUFF," is a continuation application of co-pending U.S. application Ser. No. 16/380,278, filed Apr. 10, 2019, and entitled "AN UPPER FOR AN ARTICLE OF FOOTWEAR WITH A CUFF," which is a divisional application of U.S. application Ser. No. 15/454,034, filed Mar. 9, 2017, and entitled "AN UPPER FOR AN ARTICLE OF FOOTWEAR WITH A CUFF," which claims the benefit of priority of U.S. Provisional Application No. 62/307,115, filed Mar. 11, 2016, and entitled "AN UPPER FOR AN ARTICLE OF FOOTWEAR WITH A CUFF." U.S. application Ser. Nos. 16/380,278 and 15/454,034 and U.S. Provisional Application No. 62/307,115 are incorporated herein by reference in their entirety.

BACKGROUND

A conventional article of footwear generally includes two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a wear-resistant material.

The upper of the article of footwear generally extends over the instep and toe regions of the foot, along the medial and lateral sides of the foot, and around the heel region of the foot. Access to the void on the interior of the upper is generally provided by an ankle opening in a heel region of the article of footwear. A lacing system is often incorporated into the upper to adjust the fit of the upper, thereby facilitating entry and removal of the foot from the void within the upper. In addition, the upper may include a tongue that extends under the lacing system to enhance adjustability of the article of footwear, and the upper may incorporate a heel counter to limit movement of the heel.

BRIEF DESCRIPTION

In one aspect, an upper for an article of footwear may include a knit element, a collar area configured to form an ankle opening, and a cuff in the collar area. The cuff may be at least partially formed by the knit element and may include a ribbed knit structure of the knit element.

The knit element may include a second knit structure, where a lower portion of the upper is formed of the second knit structure.

The ribbed knit structure may include at least one rib with a length extending along a longitudinal direction of the cuff.

The ribbed knit structure may include a yarn formed of an elastic material.

The cuff may include at least one opening, and the opening may be formed on a knitting machine by skipping a series of consecutive needles on a needle bed occupying a distance at least three times as large as an unstretched width of the opening.

The cuff may include at least one yarn that is substantially hidden from view from a viewpoint directed at an outer surface of the cuff when the cuff is in an unstretched state. The at least one yarn may be revealed at the viewpoint when the cuff is in a stretched state.

The cuff may be configured to form an inverted state where an end portion of the cuff is inverted to form an overlapping portion.

The knit element may include at least one inlaid strand in a toe region of the upper.

In another aspect, an upper for an article of footwear may include a knit element with a first area, the first area including a first side and a second side opposite the first side. The first side may be formed of at least 30% more material than the second side such that the first area is configured to curve convexly away from the first side.

The first side may be formed of at least 50% more material than the second side.

The first area may be at least partially located in a toe region of the upper.

The first side may include a plurality of loops forming an outer surface of the upper.

The knit element may include a second area having a different knit structure than the first area. The second area may include a cuff located in a collar area of the upper.

The first area of the knit element may be formed on a knitting machine with a first series of needles on a first needle bed and a second series of needles on a second needle bed.

The first area may include at least one yarn that forms a loop around each needle of the first series of needles during a pass when forming the first area. The at least one yarn may be tucked at least at one needle of the second series of needles during the pass.

The at least one yarn may be tucked at every other needle of the second series of needles during the pass.

In another aspect, a method of manufacturing an upper for an article of footwear may include knitting a first pass of a knit element with a knitting machine, the knitting machine having a first series of needles on a first needle bed and a second series of needles on a second needle bed, where knitting the first pass includes. The method may also include forming a loop with at least one yarn on each of the needles of the first series of needles and tucking the at least one yarn at least at one of the needles of the second series of needles.

The step of tucking the at least one yarn to at least one of the needles of the second series of needles during the first pass may include tucking the at least one yarn to every other needle of the second series of needles.

The method may further include knitting a second pass of the knit element with the knitting machine, where knitting the second pass includes forming a loop with the at least one yarn on each of the needles of the first series of needles, and where knitting the second pass includes tucking the at least one yarn at the needles of the second series of needles that are unoccupied during the first pass.

The method may further include knitting a third pass of the knit element with the knitting machine, where the third pass includes forming a loop on each of the needles of the first series of needles and skipping all of the needles of the second series of needles. The method may further include knitting a fourth pass of the knit element with the knitting machine, where the fourth pass includes forming a loop on each of the needles of the second series of needles and skipping all of the needles of the first series of needles.

DETAILED DESCRIPTION

Figure 1:
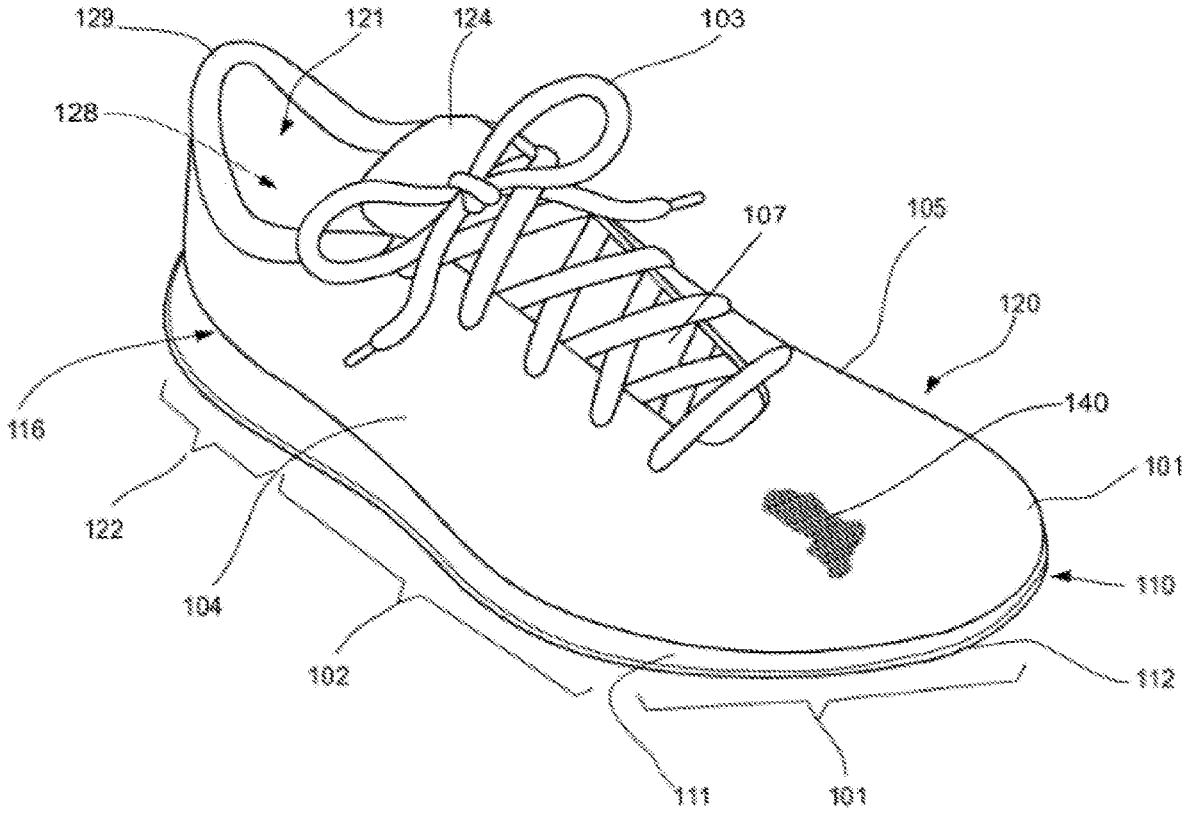
FIG. 1 shows an article of footwear in accordance with certain aspects of this disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear. The uppers may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The uppers may also be incorporated into non-athletic shoes, such as dress shoes, loafers, and sandals.

With respect to FIG. 1, an article of footwear is generally depicted as comprising a sole 110 and an upper 120. The upper 120 includes a lateral side 104, a medial side 105, and a heel region 122. The area of the shoe where the sole 110 joins the outer edge of the upper 120 may be referred to as the biteline 116. The upper 120 may be joined to the sole 110 in a fixed manner using any suitable technique, such as through the use of an adhesive, by sewing, etc.

In some embodiments, the sole 110 includes a midsole 111 and an outsole 112. The article of footwear may additionally comprise a throat 107 and an ankle opening 121, which is surrounded by a collar 129 and leads to a void 128. The upper 120 defines the void 128 of the article of footwear that accommodates a foot of a person. The throat 107 is disposed in a mid-foot region 102 of the upper 120. The mid-foot region 102 is generally a section of the upper 120 located between the heel region 122 and a toe portion 101.

In FIG. 1, a tongue 124 is disposed in the throat 107 of the article of footwear but the tongue 124 is an optional component, as is the lace 103. Although the tongue 124 depicted in FIG. 1 is a traditional tongue, the tongue 124, if included, may be any type of tongue, such as a gusseted tongue or a burrito tongue. If a tongue is not included, the lateral and medial sides of the throat 107 may be joined together, for example.

The upper 120 may be formed at least partially of a knit element 140 (and, as depicted, the upper 120 may be substantially or entirely formed of the knit element 140). While the upper 120 is herein described as including the knit element 140, it alternatively or additionally could include a textile component formed by a process other than knitting (e.g., weaving). The knit element 140 may be a multi-layer knit element such as a two-layer knit element with a first layer forming a first side and a second layer forming a second side. The first side may define the outer surface of the upper 120 and the second side may define a surface facing the void 128 of the article of footwear.

Figure 2:
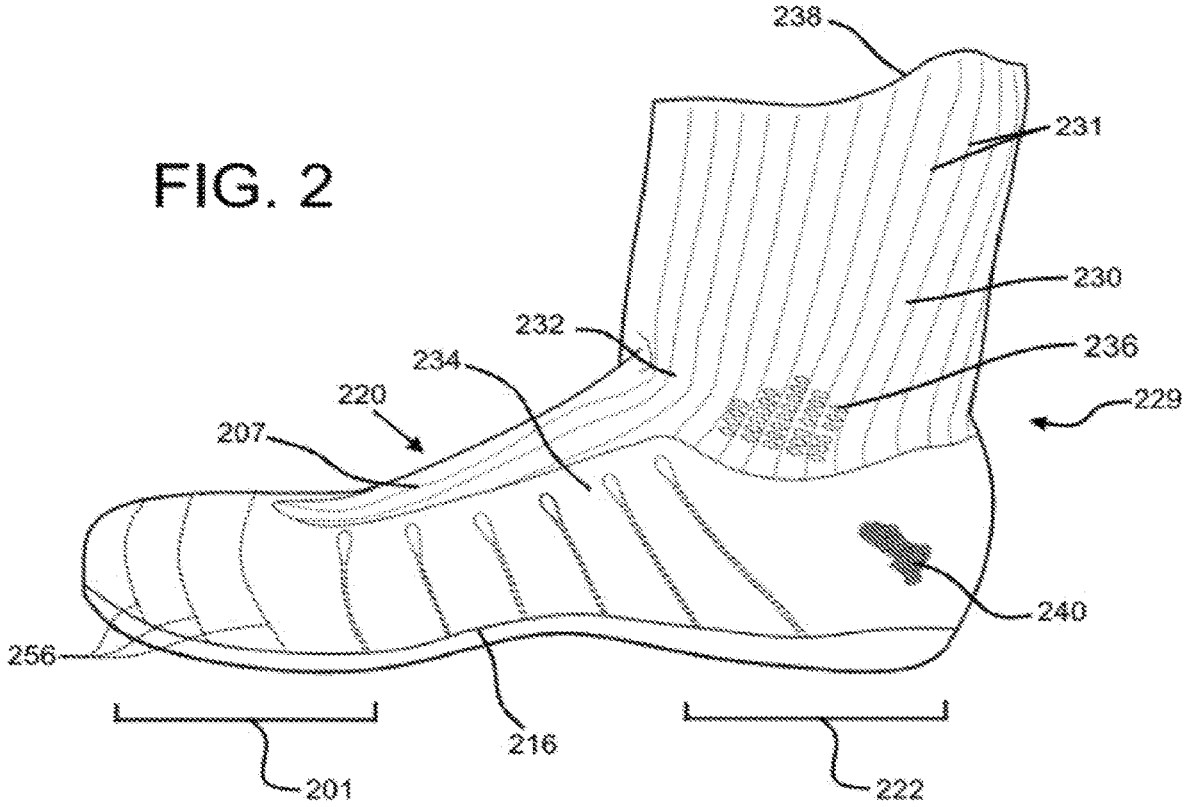
FIG. 2 shows a medial-side view of an article of footwear including a cuff.

Referring to FIG. 2, an upper 220 of the article of footwear may have a collar area 229 that leads to a void (not shown). The collar area 229 may be formed of a knit element 240. In some embodiments, the collar area 229 may include a cuff 230. The cuff 230 may be configured to surround an ankle and/or at least a portion of a leg of a person wearing the article of footwear. In some embodiments, the cuff 230 may extend about 8 inches or more above an ankle of the person wearing the article of footwear, although the height of the cuff 230 may be adjusted based on the size of the article of footwear, the type of article of footwear (e.g., the type of shoe, such as a walking shoe or basketball shoe), the preference of the person wearing the article of footwear, or the like. The cuff 230 may be advantageous, for example, by providing additional support to the ankle and/or lower leg (e.g., to prevent or reduce ankle inversion), by providing protection from harsh conditions (e.g., when the article of footwear is a boot for rugged outdoor use), by providing a foot with a comfortable and secure fit, and/or by providing desirable aesthetics.

The knit element 240 may include more than one type of knit structure, such as a ribbed knit structure, a single or double jersey knit structure, or the like. For example, as depicted, the knit element 240 may have a first portion 232 (which may include the cuff 230) that is formed of a first knit structure and a second portion 234 that is formed of a second knit structure. While the knit element 240 is described as having two knit structures, it is contemplated that more than two knit structures may be included. The first portion 232 and the second portion 234 may be knitted integrally on a knitting machine such that they do not need to be attached to one another in a post-knitting process. Further, each knit structure may vary in certain aspects at different locations (e.g., certain characteristics of the first knit structure may vary at different locations of the first portion 232).

In some embodiments, the first portion 232 may be formed of a ribbed knit structure (e.g., a full rib, a full cardigan, a 1×1 rib, a 2×1 rib, a Fisherman's rib, or an English rib), while the second portion 234 may be formed of a second knit structure that is not a ribbed knit structure (e.g., a single jersey or double jersey structure). As shown in the depicted embodiment, the first portion 232 of the knit element 240 may extend from an end portion 238 of the cuff 230 to the second portion 234 and through the throat 207 of the upper 220. The second portion 234 may extend adjacent to the biteline 216 substantially around the article of footwear from the heel region 222 on the medial side, around the toe region 201, and to the heel region 222 on the lateral side (not shown). Although not shown in FIG. 2, the knit element 240 may include a transition zone between the first portion 232 and the second portion 234 where the first knit structure of the first portion 232 transitions into the second knit structure of the second portion 234 over a distance.

The first portion 232 and the second portion 234 may have a common yarn. In some embodiments, at least one of the yarns forming the first portion 232 may be different than at least one of the yarns forming the second portion 234. For example, the first portion 232 may be at least partially formed with yarns that have an elastic material. It will be understood that the term "elastic material" as used herein shall refer to material that is more elastic than inelastic materials (inelastic materials including thermoplastic polymers, leather, synthetic leather, vinyl, or the like). Exemplary elastic materials suitable for use in the disclosed embodiments may include latex, spandex, or elastane (which are often referred to as Lycra). A fiber of elastic material (e.g., a fiber of spandex) may be stretched to twice its unstretched length, 4 times its unstretched length, or even 8 times or more its unstretched length without breaking. A yarn that is substantially made of an elastic material may be referred to herein as an "elastic yarn." These elastic yarns of the first portion 232 may be combined with yarns made of inelastic or other materials. On the other hand, the second portion 234 may be substantially free of elastic yarns. In some embodiments, the second portion 234 may be formed primarily of polyester yarns, although other suitable yarns may additionally or alternatively be used.

In some embodiments, the cuff 230 may be formed of a knit structure that exhibits a high degree of elasticity, such as a ribbed knit structure (e.g., a full cardigan knit structure or an English ribbed knit structure). Because a ribbed knit structure is particularly elastic in a direction perpendicular the length of its ribs, it may be advantageous to provide a cuff 230 with a ribbed knit structure having one or more ribs 231 extending along the longitudinal axis of the cuff 230, which may allow the cuff 230 to snugly wrap around an ankle and/or leg of a person. One particular example of a process for forming a ribbed knit structure suitable for use in the cuff 230 is illustrated by a sequential knit diagram in FIG. 3.

Figure 3:
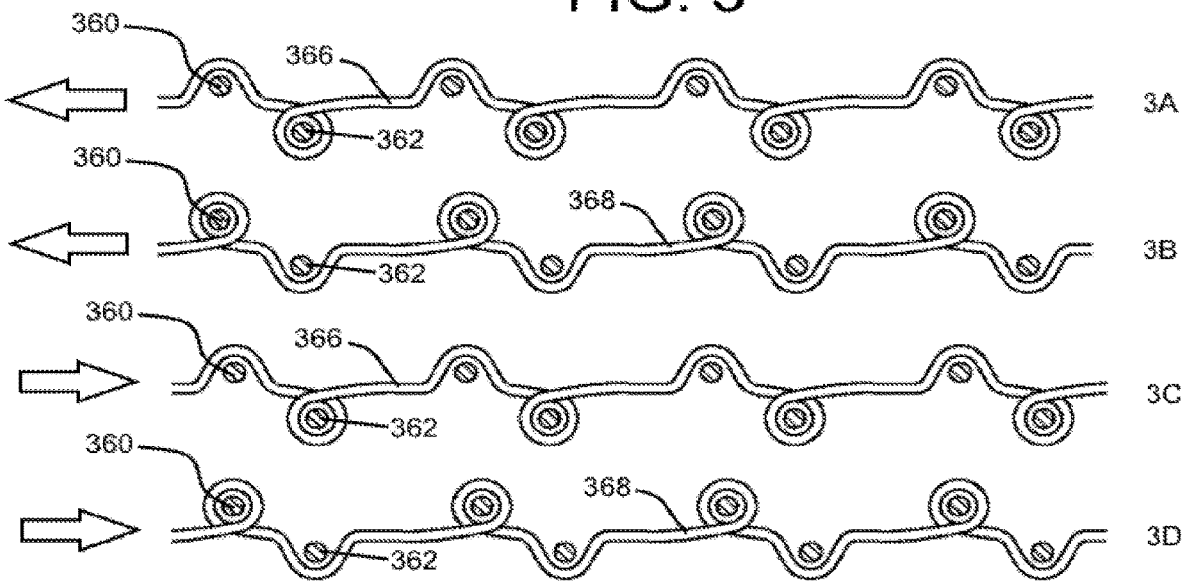
FIG. 3 illustrates a sequence for knitting a first knit structure.

Referring to FIG. 3, step 3A illustrates a pass (e.g., a yarn traveling past and/or through the needles of a knitting machine) in the left direction where a first yarn 366 forms a loop at each needle on the front needle bed 362 and is tucked at each needle on the back needle bed 360. The first yarn 366 may be a single yarn or may be a plurality of yarns or other strands. Note that the directions (left and right) and/or the needle beds (front and back) could be reversed. In step 3B, a second yarn 368 passes in the left direction where it forms a loop at each needle on the back needle bed 360 and is tucked at each needle on the front needle bed 362. The second yarn 368 may have different characteristics (e.g., elasticity, strength, denier, color) than the first yarn 366. In some embodiments, one of the first yarn 366 and the second yarn 368 is an elastic yarn, while the other is a polyester yarn. In another embodiment, they are both elastic yarns but have different colors. Next, in Step 3C, the first yarn 366, now passing to the right, forms a loop at each needle on the front needle bed 362 and is tucked at each needle on the back needle bed 360. Note that a different yarn (e.g., the second yarn 368 or a third yarn) may be utilized during this step. Finally, in the depicted step 3D, the second yarn 368, passing to the right, forms a loop at each needle of the back needle bed 360 and is tucked at each needle of the front needle bed 362. It is noted that this sequence may use any suitable number of yarns, and is not limited to just two. Each of the yarns may be selected with particular properties to thereby optimize the characteristics of the cuff 230.

The described sequence in FIG. 3 may be advantageous as it may form a stable structure that is elastic particularly in the horizontal direction when referring to FIG. 2 and FIG. 3A. This elasticity may correspond with a comfortable and secure fit around the ankle, foot, and/or leg of a wearer. The elastic effect may be amplified by utilizing one or more elastic yarns. In one non-limiting example, at least 20% of the yarns forming the cuff 230 are yarns formed at least partially of an elastic material, and in some embodiments about 50% or more (up to even 100%) of the yarns forming the cuff 230 are at least partially formed of an elastic material. For example, referring to FIG. 3, the first yarn 366 and/or the second yarn 368 may be formed of spandex. Further, the stability of the knit structure formed by this sequence in combination with spandex yarns may provide a cuff 230 that is sufficiently stable such that it does not substantially sag, bend, or otherwise deform under its own weight when the article of footwear is not in use. This structure may allow a cuff 230 being 6 inches tall, 12 inches tall, or 16 inches tall (or even taller) to stand without additional support. In exemplary embodiments, the cuff 230 may be about 8 inches tall.

In some embodiments, referring back to FIG. 2, the ribbed knit structure forming the cuff 230 may exhibit desirable aesthetic properties. For example, the first yarn 366 and the second yarn 368 described in FIG. 3 may have different colors that produce a desirable visual contrast. The knit structure formed by the sequence of FIG. 3, for example, may have two opposite sides, where one side appears to be the inverse of the other side. In some embodiments, the cuff 230 may have a dynamic visual effect when the article of footwear is in use. For example, some yarns (e.g., the second yarn 368 of FIG. 3) may be partially or substantially hidden from view from at least one viewpoint directed at the outer surface of the cuff 230 when the cuff 230 is in an unstretched state. The unstretched state may refer to a state where the article of footwear is not being worn such that the cuff 230 stands free, and/or it may refer to a state where the article of footwear is being worn but the cuff 230 is stretched to some degree less than its maximum functional amount of stretch. When the cuff 230 is then stretched beyond the unstretched state such that it shifts to a stretched state, the hidden yarns may be revealed into view from the above-mentioned viewpoint. This stretching may be the result of a person putting on the article of footwear and/or moving an ankle such that the cuff 230 is distorted. As a result, certain colors may alternate between being viewable and not being viewable as a wearer walks, run, etc. This may produce a desirable visual effect to the person wearing the article of footwear and/or an onlooker.

As shown in FIG. 2, one or more openings (depicted as the openings 236) may be formed in the cuff 230 or at another location of the knit element 240, including in areas of the knit element 240 where an elastic yarn is located. The openings may have any size, and in some embodiments may have an unstretched width from about ⅛ of an inch to about 1 inch, although it is contemplated that larger or smaller openings may be used. Any suitable number of openings may be provided. Exemplary embodiments may have anywhere from about 1 opening to about 100 openings associated with each ankle of a person, although more openings may be provided. The openings 236 may be advantageous for increasing the breathability, flexibility, and aesthetic characteristics of the article of footwear, which may be desirable particularly in athletic shoes used in circumstances where athletic performance is important.

To form an opening 236, any suitable knitting technique or other technique can be used. The openings 236 may be cut from the knit element 240 after the knit element 240 is formed. In one embodiment, the openings 236 may be formed in the knit element 240 by skipping a series of needles on one or more needle beds during a knitting process. Herein, "a series of needles" refers to two or more consecutive needles on a single needle bed of a knitting machine. The number of needles skipped during each pass may have a particular sequence (e.g., two needles are skipped during two passes, four needles are skipped during the next two passes, and then six needles are skipped during the subsequent two passes) such that the formed opening has a pyramid shape, a diamond shape, or the like. In some embodiments, each opening 236 may be formed by skipping a series of needles that occupies a distance substantially greater than an unstretched width of the opening 236 itself. To illustrate, the opening 236 may be formed with a relatively large width when on the knitting machine (e.g., when yarns surrounding the opening 236 are stretched), but the width of the opening 236 may be smaller when removed from the knitting machine and when the opening 236 is in a relaxed, unstretched state. In one example, an opening 236 may correspond to skipping a series of six consecutive needles on a standard-sized needle bed. That series of six needles may occupy a distance equal to about 2 times, 4 times, or 8 times (or more) the width of each of the plurality of openings 236 in an unstretched state when incorporated into the article of footwear. In an exemplary embodiment, the skipped series of needles occupies a distance equal to about 3 times the unstretched width of the openings 236.

Figure 4:
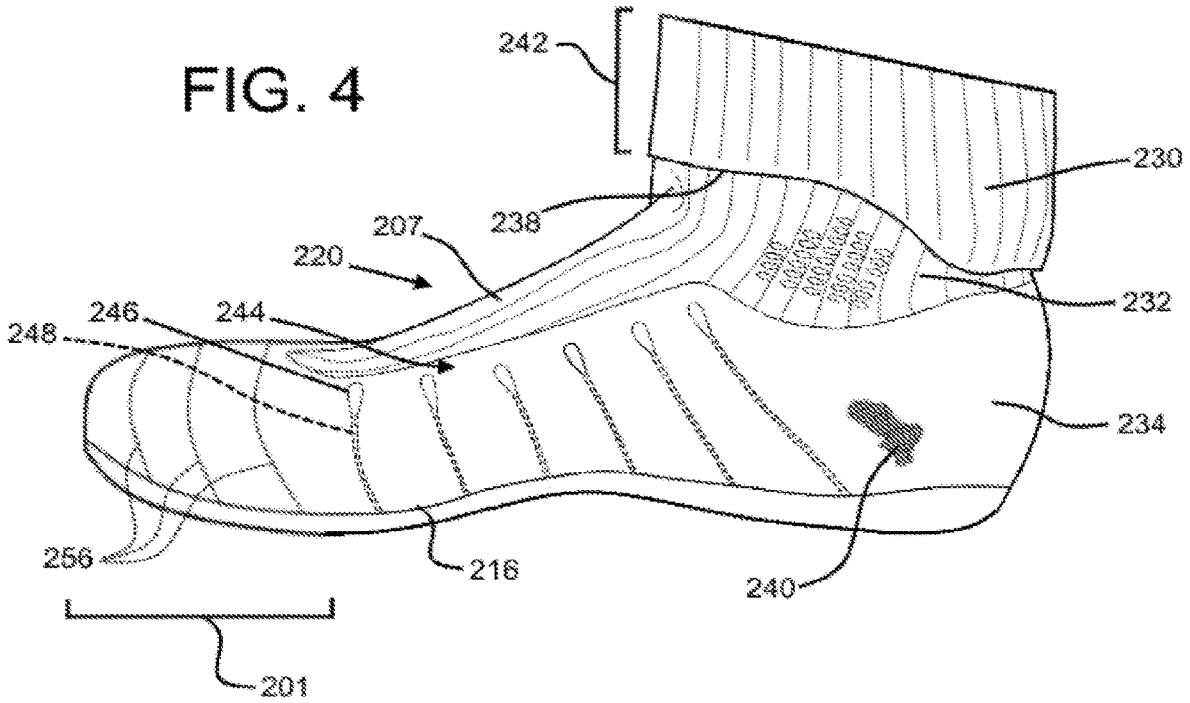
FIG. 4 shows a medial-side view of an article of footwear including a cuff, where the cuff is in an inverted state.

Referring to FIG. 4, the cuff 230 is shown in an inverted state (as opposed to an upright state shown in FIG. 2), where an overlapping portion 242 of the cuff 230 overlaps another portion of the cuff 230. Accordingly, the cuff 230 may be configured such that at least an end portion 238 of the cuff 230 can be folded over or inverted to overlap another portion of the cuff 230 to thereby form the inverted state. As depicted, the end portion 238 of the cuff 230 may be pulled down over (or alternatively under) the outer surface of the cuff 230 and may block the view of at least a portion of the outer surface. It is contemplated that in some embodiments, the overlapping portion 242 is permanent (e.g., by sewing or otherwise adhering the end portion 238 in its location as depicted in FIG. 4), although in exemplary embodiments, the cuff 230 may be configured such that a person can switch back and forth between the upright state of FIG. 2 and the inverted state of FIG. 4 while wearing the article of footwear and/or prior to putting the article of footwear on. The ability to convert from the upright state to the inverted state (and vice versa) is advantageous because the two states may be particularly suited for different functions. For example, the upright state may be particularly suited for the support and protection of an upper ankle and lower leg, while the inverted state may be particularly beneficial for comfort during casual activities, for a high degree of low-ankle support, and for facilitating the receipt and removal of a foot of the person when putting on and taking off the article of footwear. Further, it is contemplated that a removable protective device (e.g., a shin guard) or another object may be placed and held between the outer and inner layers of the overlapping portion 242. The inverted state depicted in FIG. 4 may also exhibit advantageous aesthetic properties. For example, because (as described above) the ribbed knit structure forming the cuff 230 may have different visual properties on each side (and potentially inverse visual properties), the overlapping portion 242 may produce a desirable visual contrast with the other portions of the knit element 240.

As mentioned above, a ribbed knit structure is not limited to the cuff 230, but may also occupy any other areas of the knit element 240. As shown in FIG. 4, the ribbed knit structure extends within the knit element 240 into the throat 207 of the upper 220, although this is not necessary. It is contemplated that the ribbed knit structure may occupy substantially all of the upper 220, but in exemplary embodiments, a less elastic knit structure may be used to form the second portion 234 of the upper.

The throat area 244, which is adjacent to the throat 207, may include one or more loops 246 extending from the depicted tensile strands 248. The tensile strands 248 are an optional component, and may form lace apertures (e.g., the aperture through the loops 246) to receive a lace and/or may surround other lace apertures formed in the knit element 240. A tensile strand may be a yarn, a cable, a rope, or any other type of strand. A tensile strand may be flexible, but it also may have a substantially fixed length measured from a first end to a second end. As such, the tensile strand can be substantially inelastic. The one or more tensile strands may extend across the upper 220 in any direction. The tensile strands can be at least partially inlaid within the knit element 240. The tensile strands may limit the stretch of the knit element. Also, in some aspects, portions of the tensile strands may be exposed from the knit element. For example, portions of the tensile strands may extend out of the knit element in the throat region to form the loops 246. See, for example, U.S. Patent Application Publication No. 2015/0359290, U.S. Patent Application Publication No. 2014/0237861, and U.S. Pat. No. 9,145,629, which are incorporated into the present application in their entirety.

Figure 5:
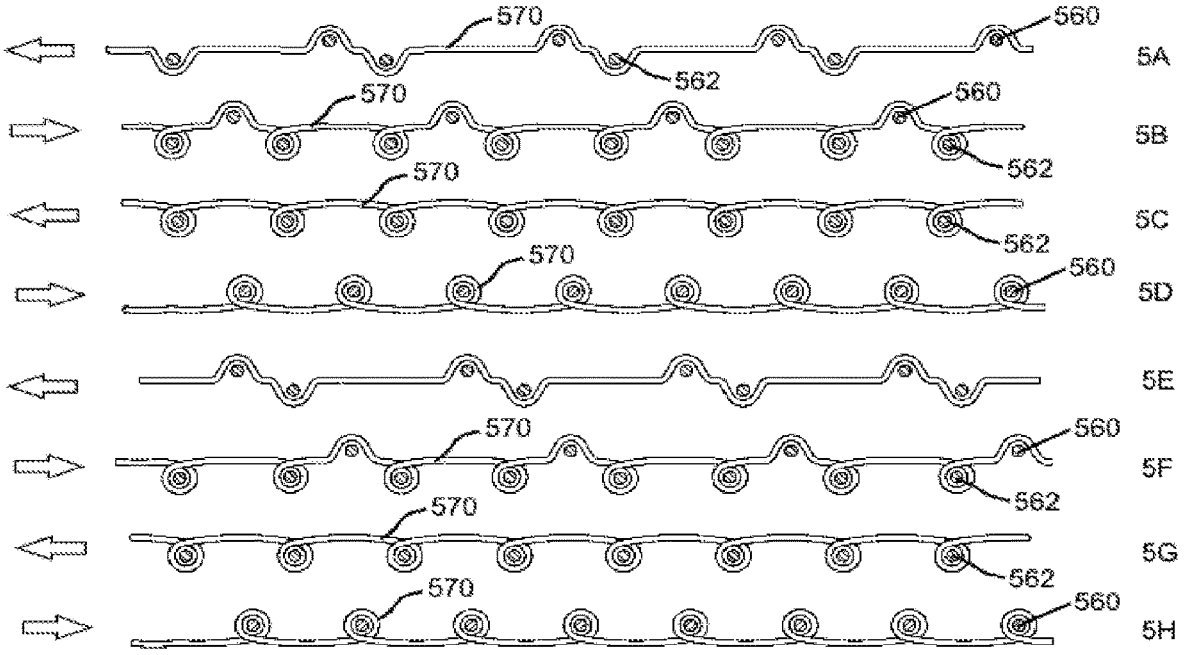
FIG. 5 illustrates of a sequence for knitting a second knit structure.

Some tensile strands 256 may extend in the toe region 201 of the knit element 240 as shown in FIGS. 2 and 4. The tensile strands 256 may be at least partially inlaid in the knit element 240, and in some embodiments they may be embedded and not visible on an outer surface of the upper 220. The tensile strands 256 may extend from the biteline 216 on a medial side to the biteline 216 on a lateral side (not shown) in the toe region 201. Advantageously, the tensile strands 256 may limit the elongation of the toe region 201 of the knit element 240, particularly in the lateral direction Any suitable knit structure may be used in the second portion 234. One exemplary knit structure that may be used may be formed by using a knitting sequence performed on a knitting machine as illustrated in FIG. 5, which may involve only a single yarn (depicted as the yarn 570), although multiple yarns could be used. Two or more of the steps 5A-5H may involve a single yarn or multiple yarns with different characteristics. Some of the yarns, and potentially all of the yarns used in this sequence, may include a polyester material. Further, more than one yarn may be involved at each step of the sequence, and each yarn may be selected with certain properties to optimize the characteristics of the second portion 234 of the knit element 240.

In FIG. 5, the depicted series of needles on the front needle bed 562 may be associated with the outer side (referred to as the first side) of the knit element 240 (shown in FIGS. 2 and 4), and the depicted series of needles on the back needle bed 560 may be associated with an inner side (referred to as the second side) of the knit element 240, although the opposite is also possible. It is also contemplated that the directions of the passes described herein may be reversed. Step 5A represents a pass in the left direction, where a tuck is performed at every other needle on the front needle bed 562 and at every other needle on the back needle bed 560 (note that the unoccupied needles are not shown in FIG. 5). In some embodiments, a tuck at 1 out of 3 needles, 2 out of 3 needles, or another fraction of needles could be used during this step instead. In step 5B, now passing to the right, a loop is formed on each of the needles of the front needle bed 562 and a tuck is performed at every other needle of the back needle bed 560. As shown in step 5B, the tucks during this pass may be performed on every opposite needle with respect to the tucks of the pass represented by step 5A. The loops formed on the front needle bed 562 in step 5B may form a portion of the outer surface of the knit element 240 (of FIGS. 2 and 4). Step 5C, now passing again to the left, involves a loop on every needle of the front needle bed 562, and step 5D, passing to the right, involves a loop on every needle of the back needle bed 560.

The sequence of steps 5A-5D may then be repeated as necessary. In some embodiments, the sequence of FIGS. 5A-5D is repeated but is offset by one needle (as depicted by steps 5E-5H). For example, as shown by step 5E, when passing to the left, a tuck may be performed on every other needle of the front needle bed 562 and every other needle of the back needle bed 560, but these tucks may occupy the needles unoccupied during the pass of step 5A. Then, as shown in step 5F, a loop may be formed on each needle of the front needle bed 562 while a tuck is performed on every other needle of the back needle bed 560, where the needles involved with the tucks on the back needle bed 560 are offset by one with respect to the tucks of step 5B. In steps 5G-5H, loops may be formed on each needle of the front needle bed 562 and each needle of the back needle bed 560, respectively. While the sequence of FIG. 5 is described herein in detail, it is contemplated that any one of the steps could be modified at one or more of the needles. Further, this sequence is not intended to be limiting, but is provided as an example of a sequence that may form a suitable knit structure for the second portion 234 (FIGS. 2 and 4) of the knit element 240.

Figure 6:
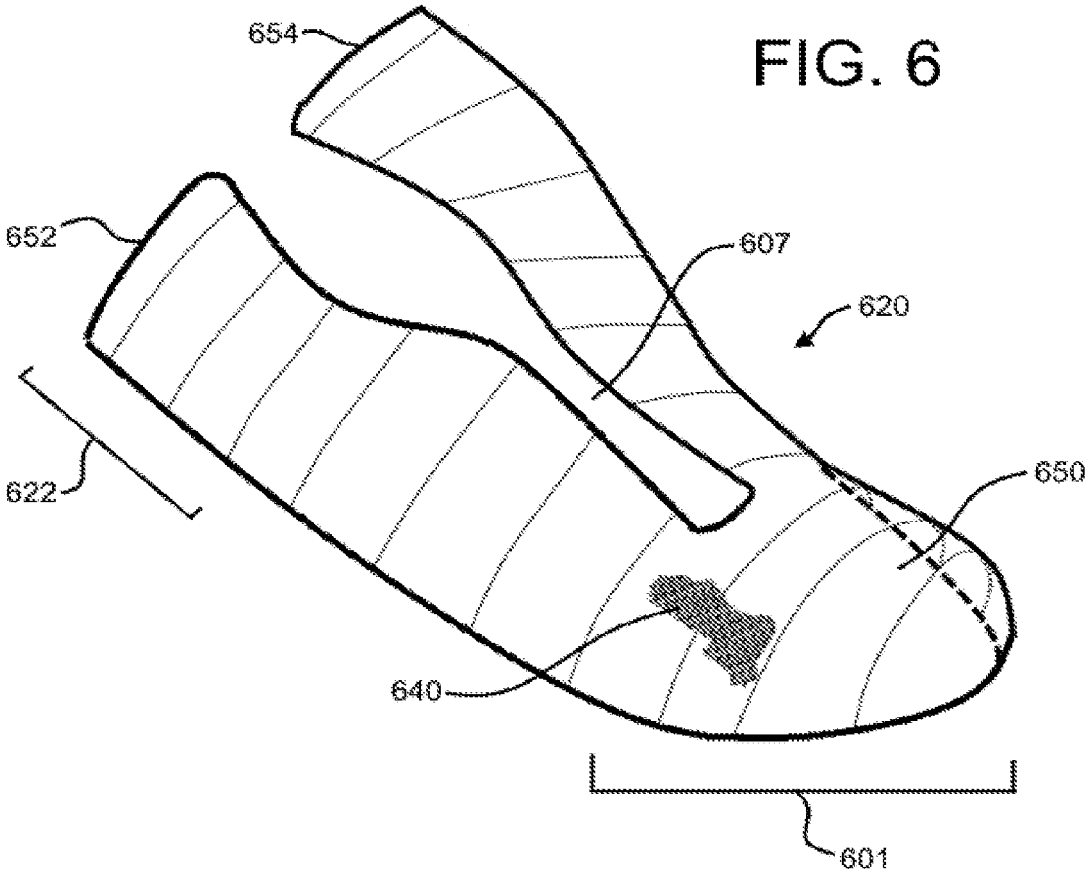
FIG. 6 shows an upper formed of a knit element having a curved portion in a toe region.

One feature of a knit structure formed by the sequence of FIG. 5 is that substantially more material is associated with one side of the knit element 240 than the other side (as measured by the surface area of yarns associated with each side). Similarly, one side may have substantially more loops than the other side. To illustrate, referring to the loops formed in the sequence illustrated by FIG. 5 (i.e., 8 passes performed over a series of 8 needles on the front needle bed 562 and a corresponding series of 8 needles on the back needle bed 560), 32 loops are formed on the front needle bed 562 while only 16 loops are formed on the back needle bed 560. Accordingly, substantially more material and substantially more loops may form the outer side (the first side) of the knit element 240 than the opposite side (the second side) of the knit element 240. In some embodiments, about 10%, 20%, 30%, 40%, 50%, 60%, or even 70% or more material and/or more loops may be associated with one side of the knit element 240 than the other. As a result of additional material and additional loops on the first side of the knit element 240, the first side of the knit element 240 may be relatively compressed (when compared to the second side), and/or the second side of the knit element 240 may be relatively tensioned (when compared to the first side). This may provide the knit element 240 with a tendency to form and retain a curved shape (as shown in FIG. 6). The tendency may be to curve convexly away from the first side (e.g., the outer side) of the knit element 240 as shown by curved portion 650 of FIG. 6.

FIG. 6 shows an upper 620 including a knit element 640 as it may appear after being formed on a knitting machine and prior to being shaped into its final form (and potentially before it is attached to other elements of the article of footwear, such as the sole 110 of FIG. 1). The upper 620 is depicted with stripes extending laterally across the upper 620 on the outer surface for purposes of illustrating the curvature in FIG. 6, but these stripes are not required. In this embodiment, the upper 620 is shown without a cuff, although a cuff may also be included. Further, in this embodiment, the knit element 640 does not extend into the throat 607. As shown, the knit element 640 may include a curved portion 650 in the toe region 601 of the upper 620. The curved portion 650 may be formed due to the natural tendency of the knit element 640 to curve in that area, for example due to more material and/or more loops forming one side than the other. In some embodiments, the curved portion 650 may be formed at a different location of the knit element 640. Multiple curved portions may be formed.

The ends 652 and 654 located in the heel region 622 of the upper 620 may be attached together (e.g., by sewing or with the use of an adhesive) to thereby form a seam in the heel region 622. This seam may, in some embodiments, extend upward to the collar and/or through a cuff. A seam may additionally or alternatively be located anywhere else on the knit element 640. In some embodiments (not shown), a seam may occur in the toe region 601 and may run through the curved portion 650, which may be advantageous when using a particular knitting machine that is limited in the amount of curvature it can provide to one integrally-knit piece of a knit element. To overcome this limitation, the knitting machine may knit two pieces of a knit element separately, both exhibiting a tendency to curve. The pieces may then be attached (by, for example, sewing) such that the sum of the curvature of the two pieces is suitable for use in an upper. In other embodiments, a knit element may be integrally knit in one piece and may be seamless at least in its toe region.

After the knitting process, the upper 620 may go through one or more post-processing steps. For example, in no particular order, the upper 620 may be attached to other elements of the article of footwear (e.g., a strobel and/or a sole), may be placed over a foot-shaped last, and may be steamed or otherwise treated to be formed into its shape for incorporation into a final product (i.e., the article of footwear). The tendency to curve, as described above, may be advantageous for facilitating the shaping of the upper 620 into its desired shape (and the retention of this desired shape) with a reduced necessity for post-processing steps. Further, the upper may form and retain its final shape without including heat-activated and/or fusible yarns such as thermoplastic polymer yarns, which have been included in a knitted upper for their ability to form and retain a certain shape of the upper when heat-activated (e.g., melted and then cooled).

In FIG. 6 the knit element 640 is depicted as clearly displaying curvature in the curved portion 650, but it is also contemplated that this curvature may not be visually apparent when the knit element 640 is removed from a knitting machine and/or is lying flat when still separate of other components of the article of footwear. However, because the knit element 640 may have more material on its first side (e.g., outer side) than its second side (e.g., inner side), the curvature may be relatively easy to achieve and may be retained if and when the upper 620 goes through post-processing steps. Further, the tendency to curve may be amplified through certain post-processing steps such as steaming, which may, for example, tighten the yarns of the knit element 640, which may increase the effect of a disparity between the amounts of material forming each side of the knit element 640.

A knit structure formed by the sequence described in FIG. 5 may also have other characteristics. For example, the knit structure of the second portion 234 (of FIG. 4) may be relatively inelastic at least when compared to the first knit structure forming the first portion 232. The second portion 234 may therefore provide structural integrity suitable for portions of the upper 220 that may particularly require strength and support and may repeatedly experience high stress. Further, the loops exposed on the outer surface of the knit element 240 (e.g., the loops formed on the front needle bed 562 of FIG. 5) may form a textured surface of the knit element 240 that produce a desirable visual effect on the outer surface of the upper 220. It is contemplated that these loops may be formed of multiple yarns with a variety of colors. Each color may be specifically located to thereby form an aesthetically pleasing pattern. Further, these loops exposed on the outer surface of the knit element 240 may provide the upper 220 with desirable functional characteristics (e.g., increased friction when gripping or contacting another object, such as a ball).

All of the structures and methods disclosed and claimed herein can be made and executed without undue experimentation in light of the present disclosure. While this invention may be embodied in many different forms, there are described in detail herein specific aspects of the invention. The present disclosure is an exemplification of the principles of the invention and is not intended to limit the invention to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various aspects described herein. It should also be understood that various changes and modifications to the aspects described herein will be apparent to those skilled in the art. Such changes and modifications can be made without departing from the spirit and scope of the invention and without diminishing its intended advantages. It is therefore intended that such changes and modifications be covered by the appended claims.

The invention claimed is:

1. An upper for an article of footwear, the upper comprising:

a knitted component comprising a knit element and an inlaid tensile strand, the knit element forming at least part of a throat area and a toe region of the upper, wherein the inlaid tensile strand is at least partially inlaid through at least one course of the knit element, and wherein a portion of the inlaid tensile strand extends through the knit element from a lateral side of the toe region, through a central portion of the toe region, and to a medial side of the toe region, and wherein a first axis extends from a biteline in the toe region to the biteline in a heel region, and wherein the portion of inlaid tensile strand extends perpendicular to the first axis.

2. The upper of claim 1, wherein the inlaid tensile strand extends from the biteline on the medial side of the upper to the biteline on the lateral side of the upper.

3. The upper of claim 1, wherein the inlaid tensile strand is embedded in the knit element such that it is not visible on an outer surface of the upper.

4. The upper of claim 1, wherein the inlaid tensile strand is configured to limit elongation of the knit element in the toe region.

5. The upper of claim 1, further comprising a second inlaid tensile strand extending through at least one course of the knit element, the second inlaid tensile strand being located in a midfoot area of the upper.

6. The upper of claim 5, wherein the second inlaid tensile strand forms a loop that is exposed from an outer surface of the knit element.

7. The upper of claim 6, wherein the loop forms an aperture adjacent to the throat area of the upper.

8. An article of footwear, the article of footwear comprising:

a knit element forming at least a toe region of an upper;

an inlaid tensile strand extending through at least one course of the knit element; and a sole structure coupled to the knit element at least at a biteline, wherein a portion of the inlaid tensile strand extends from the biteline on a lateral side of the toe region, through a central portion of the toe region, and to a medial side of the toe region, and wherein a first axis extends from the biteline in the toe region to the biteline in a heel region, and wherein the portion of inlaid tensile strand extends perpendicular to the first axis.

9. The article of footwear of claim 8, wherein the inlaid tensile strand is embedded in the knit element such that it is not visible on an outer surface of the upper.

10. The article of footwear of claim 8, wherein the inlaid tensile strand is configured to limit elongation of the knit element in the toe region.

11. The article of footwear of claim 8, further comprising a second inlaid tensile strand extending through at least one course of the knit element, the second inlaid tensile strand being located in a midfoot area of the upper.

12. The article of footwear of claim 11, wherein the second inlaid tensile strand forms a loop that is exposed from an outer surface of the knit element.

13. The article of footwear of claim 12, wherein the loop forms an aperture adjacent to a throat area of the upper, the aperture being configured to receive a lace or other fastener.

14. An upper for an article of footwear, the upper comprising:

a knit element, the knit element forming an outer surface of the upper at least at a toe region of the upper and a midfoot region of the upper;

a first inlaid tensile strand extending through at least one course of the knit element, wherein a portion of the first inlaid tensile strand extends from a lateral side of the toe region, through a central portion of the toe region, and to a medial side of the toe region; and a second inlaid tensile strand extending through at least one knit course of the knit element, wherein the second inlaid tensile strand extends through the midfoot region, and wherein a first axis extends from a biteline in the toe region to the biteline in a heel region, and wherein the portion of the first inlaid tensile strand extends perpendicular to the first axis.

15. The upper of claim 14, wherein the first inlaid tensile strand is configured to limit elongation of the knit element in the toe region.

16. The upper of claim 14, wherein the first inlaid tensile strand extends from the biteline on the medial side of the upper to the biteline on the lateral side of the upper.

17. The upper of claim 14, wherein the first inlaid tensile strand is embedded in the knit element such that it is not visible on the outer surface of the upper.

18. The upper of claim 14, wherein the second inlaid tensile strand forms a loop that is exposed from the outer surface of the knit element.

19. The upper of claim 18, wherein the loop forms an aperture adjacent to a throat area of the upper.

20. The upper of claim 19, wherein the aperture is configured to receive a lace or other fastener.

* * * * *